US008362979B2

(12) United States Patent
Murata et al.

(10) Patent No.: US 8,362,979 B2
(45) Date of Patent: Jan. 29, 2013

(54) AGGLOMERATED PARTICLES FORMING A PROTECTIVE LAYER OF A PLASMA DISPLAY PANEL

(75) Inventors: Mitsuhiro Murata, Hyogo (JP); Kaname Mizokami, Kyoto (JP); Toshikazu Wakabayashi, Osaka (JP)

(73) Assignee: Panasonic Corporation, Osaka (JP)

( * ) Notice: Subject to any disclaimer, the term of this patent is extended or adjusted under 35 U.S.C. 154(b) by 324 days.

(21) Appl. No.: 12/596,322

(22) PCT Filed: Apr. 13, 2009

(86) PCT No.: PCT/JP2009/001684

§ 371 (c)(1),
(2), (4) Date: Oct. 16, 2009

(87) PCT Pub. No.: WO2009/128236

PCT Pub. Date: Oct. 22, 2009

(65) Prior Publication Data

US 2010/0085278 A1 Apr. 8, 2010

(30) Foreign Application Priority Data

Apr. 15, 2008 (JP) ..... 2008-105419

(51) Int. Cl.
*G09G 3/28* (2006.01)
*H01J 17/49* (2006.01)

(52) U.S. Cl. ..... 345/71; 313/587

(58) Field of Classification Search ..... 345/60, 345/65–67, 71; 315/169.4; 313/581, 587
See application file for complete search history.

(56) References Cited

U.S. PATENT DOCUMENTS

| | | | | |
|---|---|---|---|---|
| 6,404,411 | B1 * | 6/2002 | Masuda et al. | 345/66 |
| 6,753,649 | B1 * | 6/2004 | Bechtel et al. | 313/587 |
| 7,973,477 | B2 * | 7/2011 | Miura et al. | 313/582 |
| 8,274,222 | B2 * | 9/2012 | Ooe et al. | 313/587 |
| 2004/0075388 | A1 * | 4/2004 | Miyashita et al. | 313/586 |
| 2006/0284559 | A1 * | 12/2006 | Naoi et al. | 313/586 |

(Continued)

FOREIGN PATENT DOCUMENTS

| | | |
|---|---|---|
| EP | 1 763 006 | 3/2007 |
| EP | 1 898 440 | 3/2008 |

(Continued)

OTHER PUBLICATIONS

Supplementary European Search Report issued Jun. 28, 2011 in European Application No. EP 09 73 1861.

(Continued)

*Primary Examiner* — Chanh Nguyen
*Assistant Examiner* — Navin Lingaraju
(74) *Attorney, Agent, or Firm* — Wenderoth, Lind & Ponack, L.L.P.

(57) ABSTRACT

In a plasma display panel, a protective layer of a front plate includes a base protective layer and a particle layer. The base protective layer is formed of a thin film containing magnesium oxide. The particle layer is formed by sticking, to base protective layer, agglomerated particles in which a plurality of single-crystal particles of magnesium oxide are agglomerated. A panel driving circuit drives the panel in a manner that subfields are temporally disposed so that a luminance weight is monotonically decreased from a subfield in which an all-cell initializing operation is performed to a subfield immediately preceding a subfield in which a next all-cell initializing operation is performed.

3 Claims, 13 Drawing Sheets

U.S. PATENT DOCUMENTS

| | | | | |
|---|---|---|---|---|
| 2007/0052630 | A1 | 3/2007 | Sato et al. | |
| 2008/0061692 | A1* | 3/2008 | Miura et al. | 313/582 |
| 2008/0068304 | A1 | 3/2008 | Itakura et al. | |
| 2008/0211409 | A1* | 9/2008 | Park et al. | 313/586 |
| 2008/0290800 | A1 | 11/2008 | Saitoh et al. | |
| 2009/0256478 | A1* | 10/2009 | Kawasaki et al. | 313/582 |
| 2011/0135928 | A1* | 6/2011 | Ravilisetty et al. | 428/402 |

FOREIGN PATENT DOCUMENTS

| | | |
|---|---|---|
| JP | 2000-105568 | 4/2000 |
| JP | 2006-54158 | 2/2006 |
| JP | 2006-147417 | 6/2006 |
| JP | 2006-244784 | 9/2006 |
| JP | 2008-293772 | 12/2008 |

OTHER PUBLICATIONS

International Search Report issued May 19, 2009 in International (PCT) Application No. PCT/JP2009/001684.

European Office Action mailed Jan. 27, 2012 in corresponding European Application No. 09 731 861.2.

Full English translation of JP 2006-244784.

* cited by examiner

AGGLOMERATED PARTICLES FORMING A PROTECTIVE LAYER OF A PLASMA DISPLAY PANEL

TECHNICAL FIELD

The present invention relates to a plasma display device, which is an image display device using a plasma display panel.

BACKGROUND ART

Among thin-type image display devices, a plasma display panel (hereinafter simply referred to as "panel") allows high-speed display and can be easily upsized. Thus a plasma display panel is commercialized as a large-screen image display device.

The panel is formed of a front plate and a back plate bonded together.

The front plate has the following elements:

a glass substrate;

display electrode pairs, each formed of a scan electrode and a sustain electrode, disposed on the glass substrate;

a dielectric layer formed to cover the display electrode pairs; and a protective layer formed on the dielectric layer.

The protective layer is disposed to protect the dielectric layer from ion collision and to facilitate generation of discharge.

The back plate has the following elements:

a glass substrate;

data electrodes formed on the glass substrate;

a dielectric layer covering the data electrodes;

barrier ribs formed on the dielectric layer; and phosphor layers formed between the barrier ribs and emitting light of red, green, and blue colors.

The front plate and the back plate are faced to each other so that the display electrode pairs and the data electrodes intersect with each other and sandwich a discharge space between the electrodes. The peripheries of the plates are sealed with a low-melting glass. A discharge gas containing xenon is sealed into the discharge space. Discharge cells are formed in parts where the display electrode pairs are faced to the data electrodes.

In a plasma display device having a panel structured as above, a gas discharge is caused selectively in the respective discharge cells of the panel, and the ultraviolet light generated at this time excites the red, green, and blue phosphors so that light is emitted for color display.

A subfield method is typically used as a method for driving the panel. That is, one field period is divided into a plurality of subfields, and gradation display is provided by the combination of subfields in which light is emitted. Each subfield has an initializing period, an address period, and a sustain period. In the initializing period, predetermined voltages are applied to the scan electrodes and sustain electrodes, to cause an initializing discharge and to form wall charge necessary for the subsequent address operation on the respective electrodes. In the address period, a scan pulse is sequentially applied to the scan electrodes, and an address pulse is applied selectively to the data electrodes to cause an address discharge and form wall charge. In the sustain period, sustain pulses are applied alternately to the display electrode pairs. Thereby, a sustain discharge is caused selectively in the discharge cells to cause the phosphor layers of the corresponding discharge cells to emit light. In this manner, an image is displayed.

In order to display a high quality image, control is made so that the discharge cells to be lit are lit and the discharge cells to be unlit are unlit without fail. For this control, it is necessary to perform reliable address operation within an assigned time period. For this purpose, development of a panel that can be driven at high speed is promoted, and studies are proceeding on a driving method and a driving circuit for displaying high quality images by making full use of the performance of the panel.

The discharge characteristics of a panel depend largely on the characteristics of its protective layer. Particularly, in order to improve electron emission performance and charge retention performance that have considerable influence on whether or not the panel can be driven at high speed, many studies are made on the materials, structures, and manufacturing methods of the protective layer. For example, Patent Literature 1 discloses a plasma display device that has a panel and an electrode driving circuit. In this plasma display device, the panel includes a magnesium oxide layer that is made from magnesium vapor by gas-phase oxidation and has a cathode luminescence light emission peak at 200 nm to 300 nm. In address periods, the electrode driving circuit sequentially applies a scan pulse to one electrode of each one of display electrode pairs constituting the all display lines, and supplies, to the data electrodes, an address pulse corresponding to the display lines applied with the scan pulse.

In recent years, a plasma display device having high definition as well as a large screen has been demanded. For example, a high-definition plasma display device that has 1920 pixels×1080 lines, and an extremely high-definition plasma display device that has 2160 lines or 4320 lines have been demanded. While the number of lines is increased as described above, the number of subfields for displaying smooth gradation needs to be secured. Thus the time assigned for the address operation per line tends to be further shortened. Therefore, in order to perform a reliable address operation within the assigned time, there is a demand for a panel capable of performing more stable address operation at higher speed than those of conventional arts, a driving method for the panel, and a plasma display device that has a driving circuit for implementing the method.

[Patent Literature 1] Japanese Patent Unexamined Publication No. 2006-54158

SUMMARY OF THE INVENTION

A plasma display device has a panel and a panel driving circuit. The panel has a front plate and a back plate faced to each other. The front plate has display electrode pairs formed on a first glass substrate, a dielectric layer formed to cover the display electrode pairs, and a protective layer formed on the dielectric layer. The back plate has data electrodes formed on a second glass substrate. Discharge cells are formed in positions where the display electrode pairs are faced to the data electrodes. The panel driving circuit drives the panel in a manner that a plurality of subfields are temporally disposed to form one field period. Each of the subfields has an initializing period for causing an initializing discharge, an address period for causing an address discharge, and a sustain period for causing a sustain discharge, in the discharge cells. The protective layer has a base protective layer and a particle layer. The base protective layer is formed of a thin film containing a metal oxide. The particle layer is formed by sticking, to the base protective layer, agglomerated particles in which a plurality of single-crystal particles of magnesium oxide are agglomerated. The panel driving circuit drives the panel in the following manner. In the initializing periods, one of an all-cell initializing operation for causing an initializing discharge in all the discharge cells and a selective initializing operation for causing an initializing discharge in the discharge cells having undergone a sustain discharge is performed. Further, the subfields are temporally disposed so that the luminance weight is monotonically decreased from the subfield in which the all-cell initializing operation is performed to the subfield immediately preceding the subfield in which the next all-cell initializing operation is performed.

REFERENCE MARKS IN THE DRAWINGS

Figure 1:
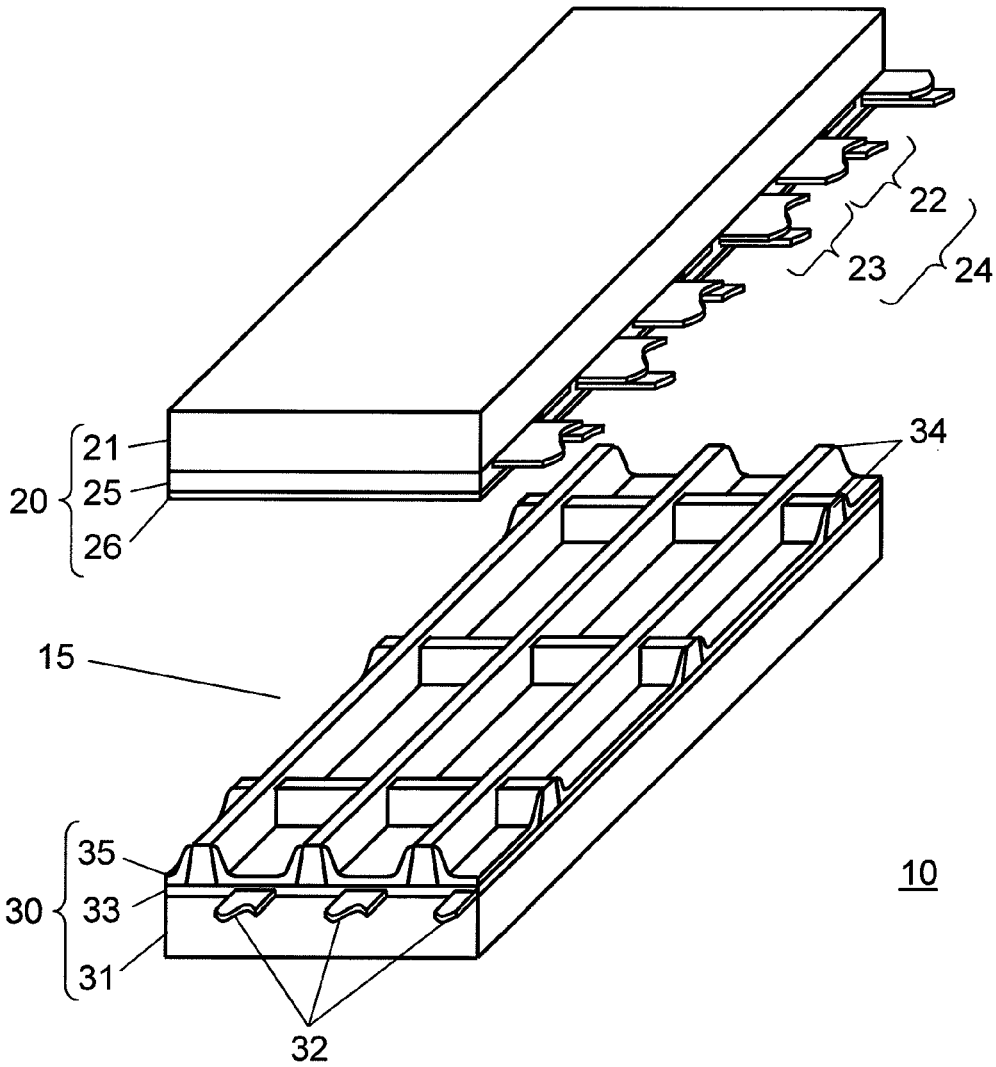
FIG. 1 is a perspective view showing a structure of a panel in accordance with an exemplary embodiment of the present invention.

10 Panel
20 Front plate
21 (First) glass substrate
22 Scan electrode
22*a*, 23*a* Transparent electrode
22*b*, 23*b* Bus electrode
23 Sustain electrode
24 Display electrode pair
25 Dielectric layer
26 Protective layer
26*a* Base protective layer
26*b* Particle layer
27 Single-crystal particle
28 Agglomerated particle
30 Back plate
31 (Second) glass substrate
32 Data electrode
34 Barrier rib
35 Phosphor layer
41 Image signal processing circuit
42 Data electrode driving circuit
43 Scan electrode driving circuit
44 Sustain electrode driving circuit
45 Timing generating circuit
50, 80 Sustain pulse generating circuit
60 Initializing waveform generating circuit
70 Scan pulse generating circuit
100 Plasma display device

DETAILED DESCRIPTION OF PREFERRED EMBODIMENT

A plasma display device in accordance with an exemplary embodiment of the present invention is demonstrated hereinafter with reference to the accompanying drawings.

Exemplary Embodiment

FIG. 1 is a perspective view showing a structure of panel 10 in accordance with the exemplary embodiment of the present invention. In panel 10, front plate 20 and back plate 30 are faced to each other, and the outer peripheries of the plates are sealed with a sealing material, a low-melting glass. A discharge gas containing xenon, or the like, is sealed into discharge space 15 inside of panel 10 at a pressure in the range of 400 Torr to 600 Torr.

A plurality of display electrode pairs 24, each formed of scan electrode 22 and sustain electrode 23, are formed parallel to each other on glass substrate (first glass substrate) 21 of front plate 20. Dielectric layer 25 is formed on glass substrate 21 so as to cover display electrode pairs 24. Further, protective layer 26 predominantly composed of magnesium oxide is formed on dielectric layer 25.

A plurality of data electrodes 32 are formed parallel to each other on glass substrate (second glass substrate) 31 of back plate 30 in the direction orthogonal to display electrode pairs 24. Dielectric layer 33 covers the data electrodes. Further, barrier ribs 34 are formed on dielectric layer 33. Phosphor layers 35 caused to emit red, green, or blue light by ultraviolet light are formed on dielectric layer 33 and the side faces of barrier ribs 34. A discharge cell is formed in a position where display electrode pair 24 intersects with data electrode 32. A set of discharge cells having red, green, and blue phosphor layers 35 forms a pixel for color display. Dielectric layer 33 is not essential, and may be omitted from the structure of the panel.

Figure 2:
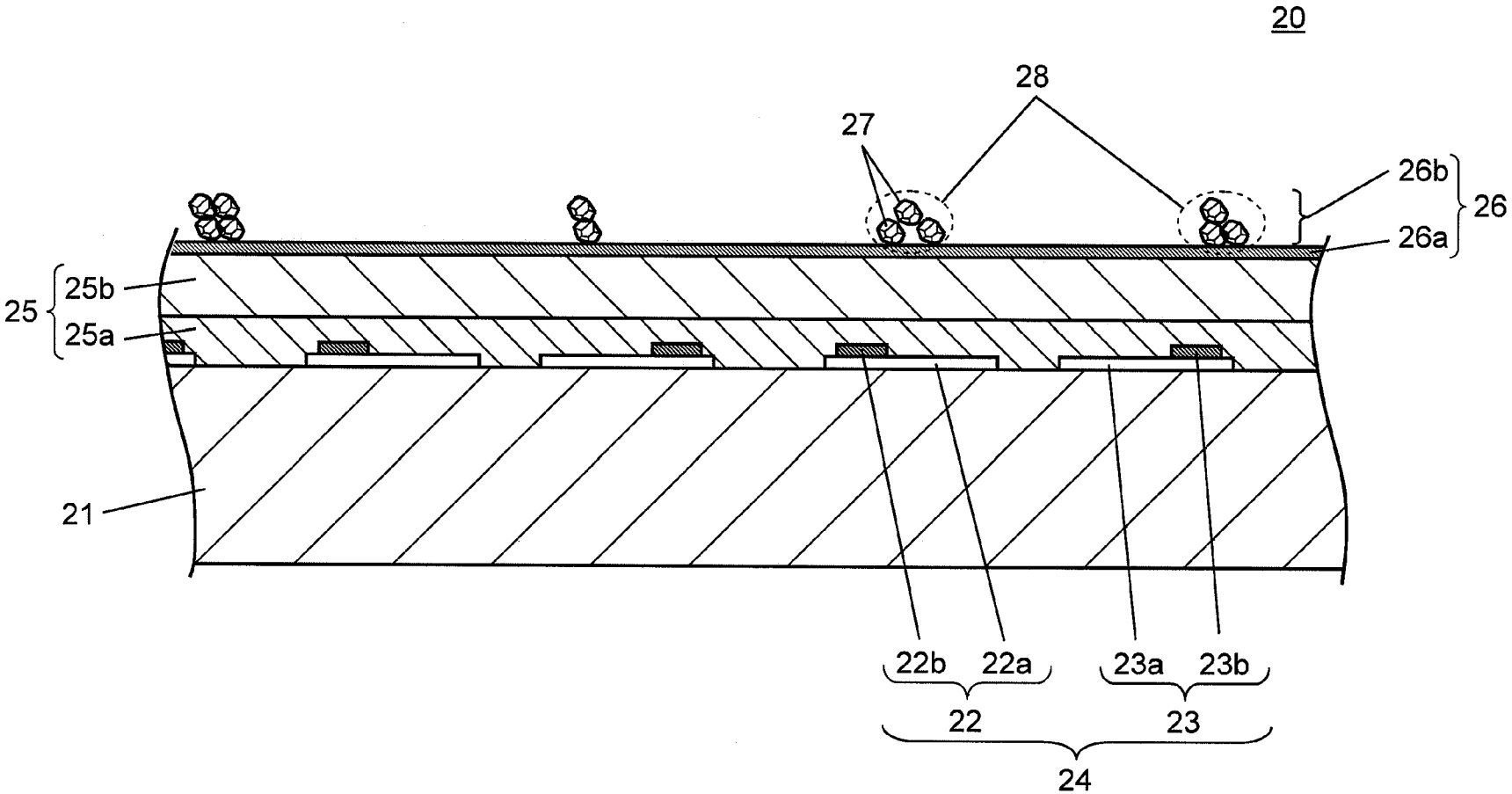
FIG. 2 is a sectional view showing a structure of a front plate of the panel.

FIG. 2 is a sectional view showing a structure of front plate 20 of panel 10 in accordance with the exemplary embodiment of the present invention. In FIG. 2, front plate 20 of FIG. 1 is vertically inverted. Display electrode pairs 24, each formed of scan electrode 22 and sustain electrode 23, are formed on glass substrate 21. Each scan electrode 22 is formed of transparent electrode 22*a* composed of indium tin oxide, tin oxide, or the like, and bus electrode 22*b* disposed on transparent electrode 22*a*. Similarly, each sustain electrode 23 is formed of transparent electrode 23*a*, and bus electrode 23*b* disposed on the transparent electrode. Bus electrodes 22*b* and bus electrodes 23*b* are disposed to impart conductivity in the longitudinal direction of respective transparent electrodes 22*a* and transparent electrodes 23*a,* and are formed of a conductive material predominantly composed of silver.

In this embodiment, dielectric layer 25 has a two-layer structure formed of first dielectric layer 25*a* and second dielectric layer 25*b* disposed on first dielectric layer 25*a.* First dielectric layer 25*a* is formed to cover transparent electrodes 22*a,* transparent electrodes 23*a,* bus electrodes 22*b,* and bus electrodes 23*b.* However, dielectric layer 25 does not need to have the two-layer structure necessarily, and may be structured to have a single layer, or three or more layers.

On dielectric layer 25, protective layer 26 is formed. Protective layer 26 is detailed hereinafter. The protective layer protects dielectric layer 25 from ion collision, and improves electron emission performance and charge retention performance that have considerable influence on driving speed. For this purpose, protective layer 26 has base protective layer 26*a* formed on second dielectric layer 25*b,* and particle layer 26*b* formed on base protective layer 26*a.*

Base protective layer 26*a* is a thin film predominantly composed of magnesium oxide, and has a thickness in the range of 0.3 μm to 1.0 μm, for example.

Figure 3:
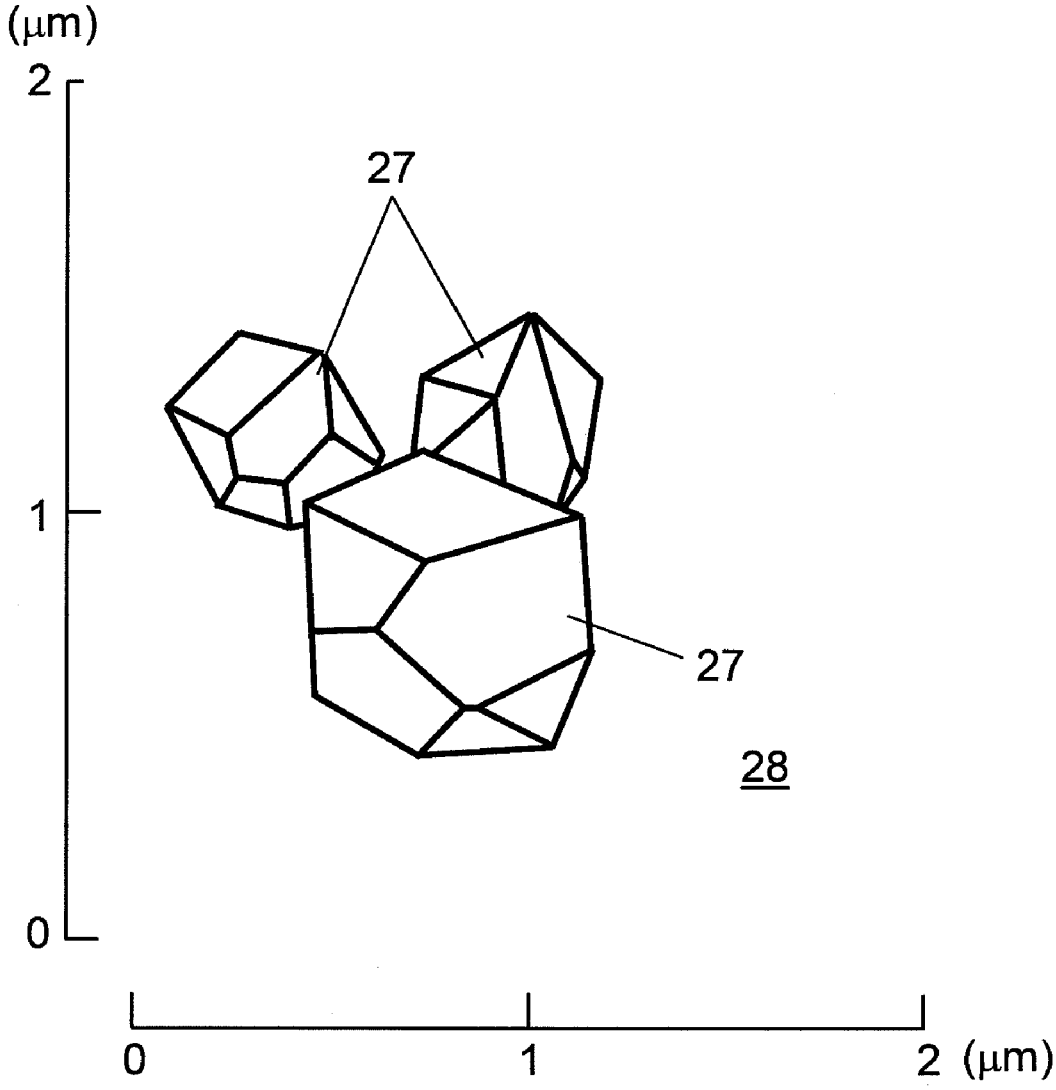
FIG. 3 is a diagram showing an example of an agglomerated particle of the panel.

Particle layer 26*b* is formed by discretely sticking agglomerated particles 28 in which a plurality of single-crystal particles 27 of magnesium oxide are agglomerated so that the agglomerated particles are substantially uniformly distributed across the entire surface of base protective layer 26*a.* In FIG. 2, agglomerated particles 28 are enlarged. FIG. 3 is a diagram showing an example of agglomerated particle 28 of panel 10 in accordance with the exemplary embodiment of the present invention. Agglomerated particle 28 is in a state where single-crystal particles 27 are agglomerated or necked in this manner. The plurality of single-crystal particles 27 are formed into an aggregate by static electricity, van der Waals force, or the like. Preferably, each single-crystal particle 27 is shaped into a polyhedron having at least seven faces, such as a tetradecahedron and dodecahedron, and has a particle diameter in the range of approximately 0.9 μm to 2.0 μm. Preferably, in agglomerated particle 28, two to five single-crystal particles 27 are agglomerated. Preferably, each agglomerated particle 28 has a particle diameter in the range of approximately 0.3 μm to 5 μm.

Single-crystal particles 27 and agglomerated particles 28 made of the agglomerated single-crystal particles that satisfy the above conditions can be produced in the following manner. When a magnesium oxide precursor, such as magnesium carbonate and magnesium hydroxide, is fired to provide such particles, the particle diameter can be controlled to approximately 0.3 μm to 2 μm by setting a relatively high firing temperature of at least 1000° C. Further, firing the magnesium oxide precursor can provide agglomerated particles 28 in which single-crystal particles 27 are agglomerated or necked with each other.

Next, a description is provided for an advantageous effect of the above protective layer 26. In order to verify the advantageous effect of protective layer 26 of the exemplary embodiment, trial panels that have three types of protective layer different in structure are fabricated and their discharge characteristics are examined. A first type of trial panel includes a protective layer that has only base protective layer 26*a* formed of a thin film predominantly composed of magnesium oxide. A second type of trial panel has thin-film base protective layer 26*a* predominantly composed of magnesium oxide, and single-crystal particles 27 of magnesium oxide stuck to the base protective layer by spraying instead of agglomeration. A third type of trial panel is in accordance with the exemplary embodiment. In this panel, single-crystal particles 27 of magnesium oxide are agglomerated onto thin-film base protective layer 26*a* predominantly composed of magnesium oxide in a manner that agglomerated particles 28 are discretely stuck to the base protective layer so as to be substantially uniformly distributed across the entire surface.

Electron emission performance and charge retention performance are examined for these three types of panel. When the electron emission performance is higher, discharge more easily occurs and the discharge delay is smaller. Thus, in each of the three types of panel, a discharge delay time is measured for estimation of a statistical delay time. Numerical value K, a value obtained by integrating the inverse number of the statistical delay time, is set as a numerical value indicating the electron emission performance of each panel. Therefore, a panel exhibiting larger value K has higher electron emission performance.

When a panel has low charge retention performance, it is necessary to increase the scan pulse voltage applied to scan electrodes 22 to compensate for the electric charge, and the address pulse voltage applied to data electrodes 32, in a panel driving method to be described later. Thus minimum voltage Vmin of the scan pulse necessary for driving each panel is used as a numerical value indicating the charge retention performance. Therefore, a panel exhibiting lower voltage Vmin has higher charge retention performance.

Figure 4:
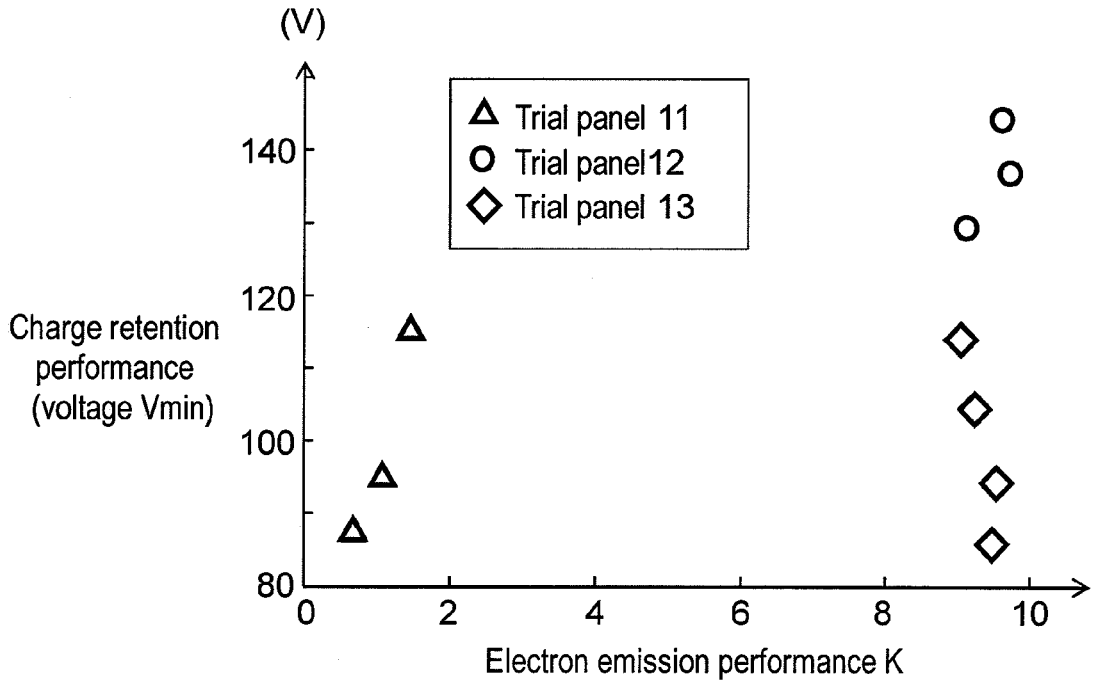
FIG. 4 is a graph showing electron emission performance and charge retention performance of trial panels including the panel.

FIG. 4 is a graph that shows electron emission performance and charge retention performance of the three types of trial panel 11 through trial panel 13 including the panel of the exemplary embodiment. The first type, trial panel 11, has low voltage Vmin and small numerical value K. These values show that the panel has high charge retention performance but low electron emission performance. The second type, trial panel 12, has both high voltage Vmin and large numerical value K. These values show that the panel has high electron emission performance but low charge retention performance.

In contrast, the third type, trial panel 13 in accordance with the exemplary embodiment, has low voltage Vmin and large numerical value K. These values show that the panel exhibits excellent characteristics, i.e. high electron emission performance and high charge retention performance. As described above, protective layer 26 has thin-film base protective layer 26*a* predominantly composed of magnesium oxide, and particle layer 26*b.* In particle layer 26*b,* single-crystal particles 27 of magnesium oxide are agglomerated onto base protective layer 26*a* in a manner that agglomerated particles 28 are stuck to the base protective layer so as to be substantially uniformly distributed across the entire surface. With this structure, panel 10 exhibiting excellent characteristics, i.e. high electron emission performance and high charge retention performance, can be obtained.

Next, the particle diameter of single-crystal particle 27 is described. In the following descriptions, the particle diameter means a median diameter.

Figure 5A:
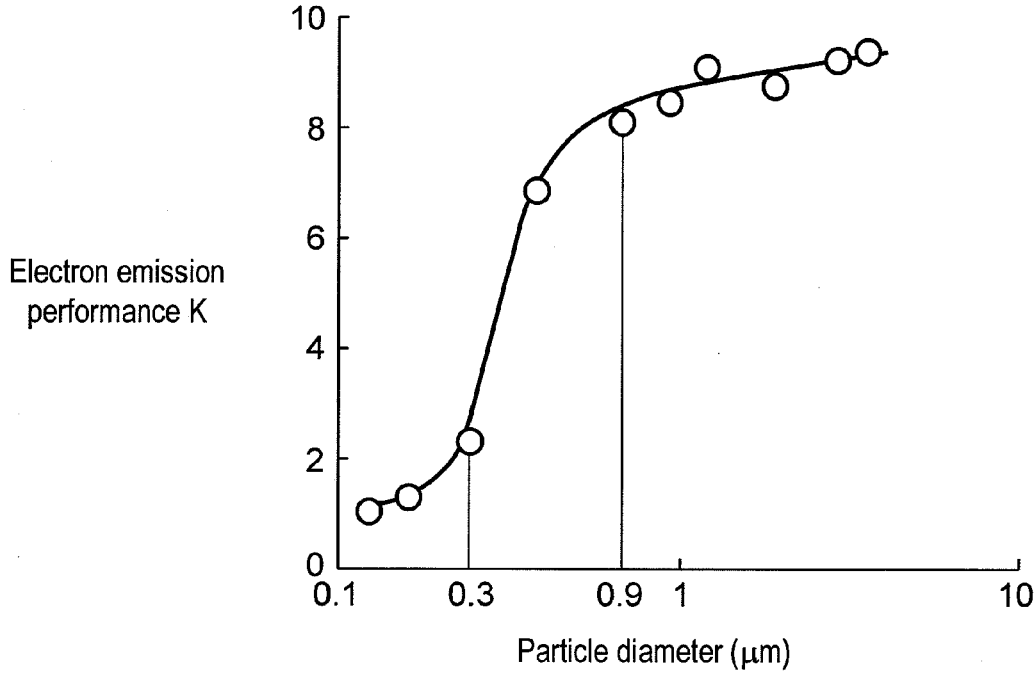
FIG. 5A is a graph showing experimental results obtained by examination of electron emission performance when the particle diameter of a single-crystal particle of one of the trial panels is changed.
Figure 5B:
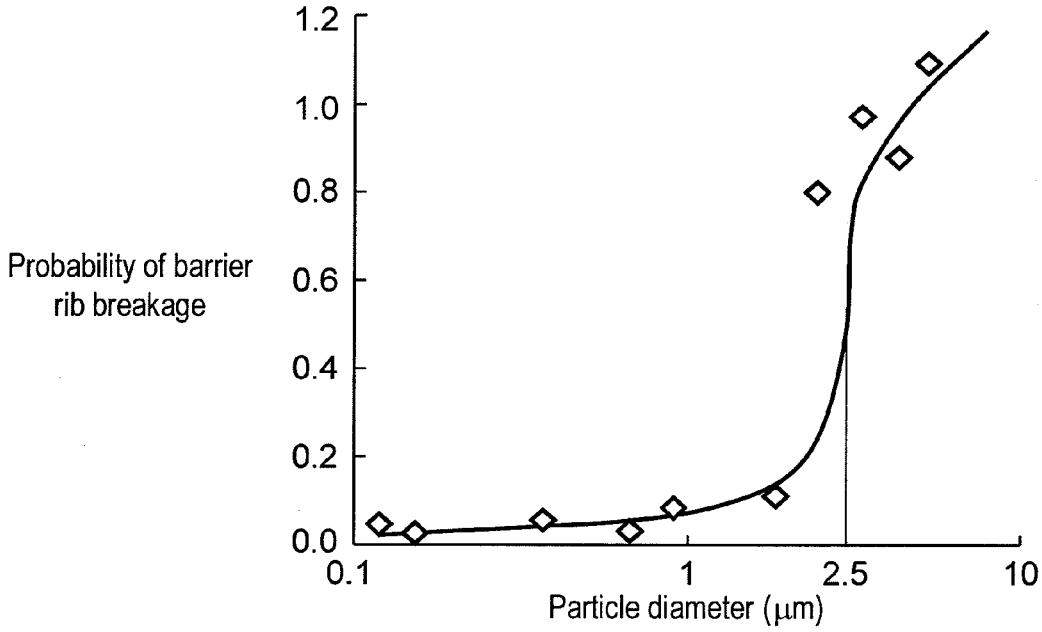
FIG. 5B is a graph showing the relation between the particle diameter of the single-crystal particle and breakage of barrier ribs in the trial panel.

FIG. 5A is a graph showing experimental results obtained by examination of electron emission performance when the particle diameter of single-crystal particle 27 of trial panel 13 is changed. The particle diameters of single-crystal particles 27 are measured through microscopic observation. According to the experimental results, when the particle diameter of single-crystal particle 27 is as small as approximately 0.3 μm, the electron emission performance is low. When the particle diameter is approximately 0.9 μm or larger, high electron emission performance can be obtained. However, the inventors have verified the following fact based on the experiments. The presence of single-crystal particles 27 having large particle diameters in positions in intimate contact with the top parts of barrier ribs 34 of back plate 30 increases the probability of breakage of the top parts of barrier ribs 34. FIG. 5B is a graph showing the relation between the particle diameter of single-crystal particle 27 and breakage of barrier ribs 34 in trial panel 13. As shown in the graph, when the particle diameter of single-crystal particle 27 reaches as large as approximately 2.5 μm, the probability of barrier rib breakage is suddenly increased. In contrast, for a crystal particle diameter smaller than 2.5 μm, the probability of barrier rib breakage can be suppressed relatively low.

The above results show that the particle diameters of single-crystal particles 27 in the range of 0.9 μm to 2.5 μm are preferable. However, in consideration of variations in production, for example, it is preferable to use agglomerated particles 28 that are made of single-crystal particles 27 having particle diameters in the range of 0.9 μm to 2 μm. Forming protective layer 26 in this manner allows panel 10 to have no risk of breakage of barrier ribs 34 and to exhibit excellent characteristics, i.e. high electron emission performance and high charge retention performance.

In the exemplary embodiment, a description is provided for panel 10 that includes thin-film base protective layer 26*a* predominantly composed of magnesium oxide. However, the present invention is not limited to this structure. Protective layer 26 is disposed to protect dielectric layer 25 from ion collision and to facilitate generation of discharge. In the exemplary embodiment, protective layer 26 is made of base protective layer 26*a* and particle layer 26*b*. Base protective layer 26*a* mainly serves to protect dielectric layer 25; particle layer 26*b* mainly serves to facilitate generation of discharge. For this purpose, base protective layer 26*a* may be formed of other materials that contain magnesium oxide containing aluminum, aluminum oxide, or a highly sputter-resistant metal oxide. As single-crystal particles 27 forming particle layer 26*b*, magnesium oxide containing strontium, calcium, barium, aluminum, or the like can be used. Single-crystal particles predominantly composed of strontium oxide, calcium oxide, barium oxide, or the like can also be used to form particle layer 26*b*.

Next, a description is provided for a method for driving panel 10 of the exemplary embodiment of the present invention.

Figure 6:
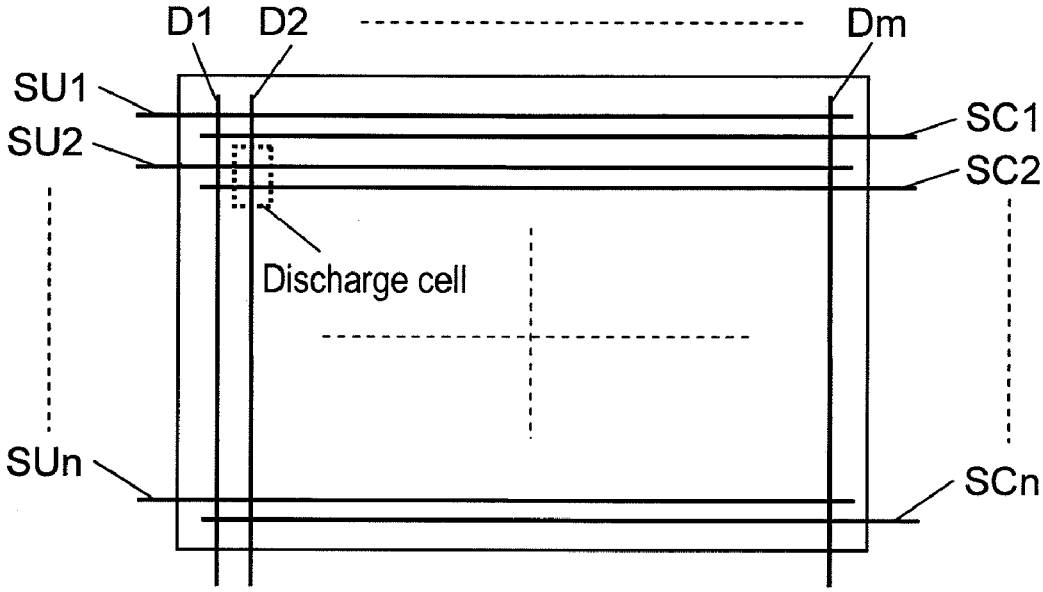
FIG. 6 is a diagram showing an electrode array of the panel in accordance with the exemplary embodiment of the present invention.

FIG. 6 is a diagram showing an electrode array of panel 10 in accordance with the exemplary embodiment of the present invention. Panel 10 has n scan electrodes SC1 through SCn (scan electrodes 22 in FIG. 1) and n sustain electrodes SU1 through SUn (sustain electrodes 23 in FIG. 1) both long in the row (line) direction, and m data electrodes D1 through Dm (data electrodes 32 in FIG. 1) long in the column direction. A discharge cell is formed in the part where a pair of scan electrode SCi (i is 1 through n) and sustain electrode SUi intersects with one data electrode Dj (j is 1 through m). Thus m×n discharge cells are formed in the discharge space. For example, the number of discharge cells in a panel for use in a high-definition plasma display device is represented by the following values:

$$m=1920\times3=5760, \text{ and } n=1080$$

Next, a description is provided for driving voltage waveforms to be applied to the respective electrodes to drive panel 10. Panel 10 is driven by a subfield method in which a plurality of subfields are temporally disposed to form one field period. That is, one field period is divided into a plurality of subfields, and light emission and no light emission of each discharge cell are controlled in each subfield for gradation display. Each subfield has an initializing period, an address period, and a sustain period.

In the initializing period, an initializing discharge is caused to form wall charge necessary for the subsequent address discharge on the respective electrodes. The initializing operations include the following two types: an initializing operation for causing an initializing discharge in all the discharge cells (hereinafter simply referred to as "all-cell initializing operation"), and an initializing operation for causing an initializing discharge in the discharge cells having undergone a sustain discharge in the sustain period of the immediately preceding subfield (hereinafter "selective initializing operation").

In the address period, an address discharge is caused selectively in the discharge cells to be lit, so that wall charge is formed in the cells. In the sustain period, sustain pulses corresponding in number to a luminance weight are applied alternately to the display electrode pairs. Thereby, a sustain discharge is caused for light emission in the discharge cells having undergone the address discharge. The subfield structure will be detailed later. Here, the driving voltage waveforms and operation thereof in each subfield are described.

Figure 7:
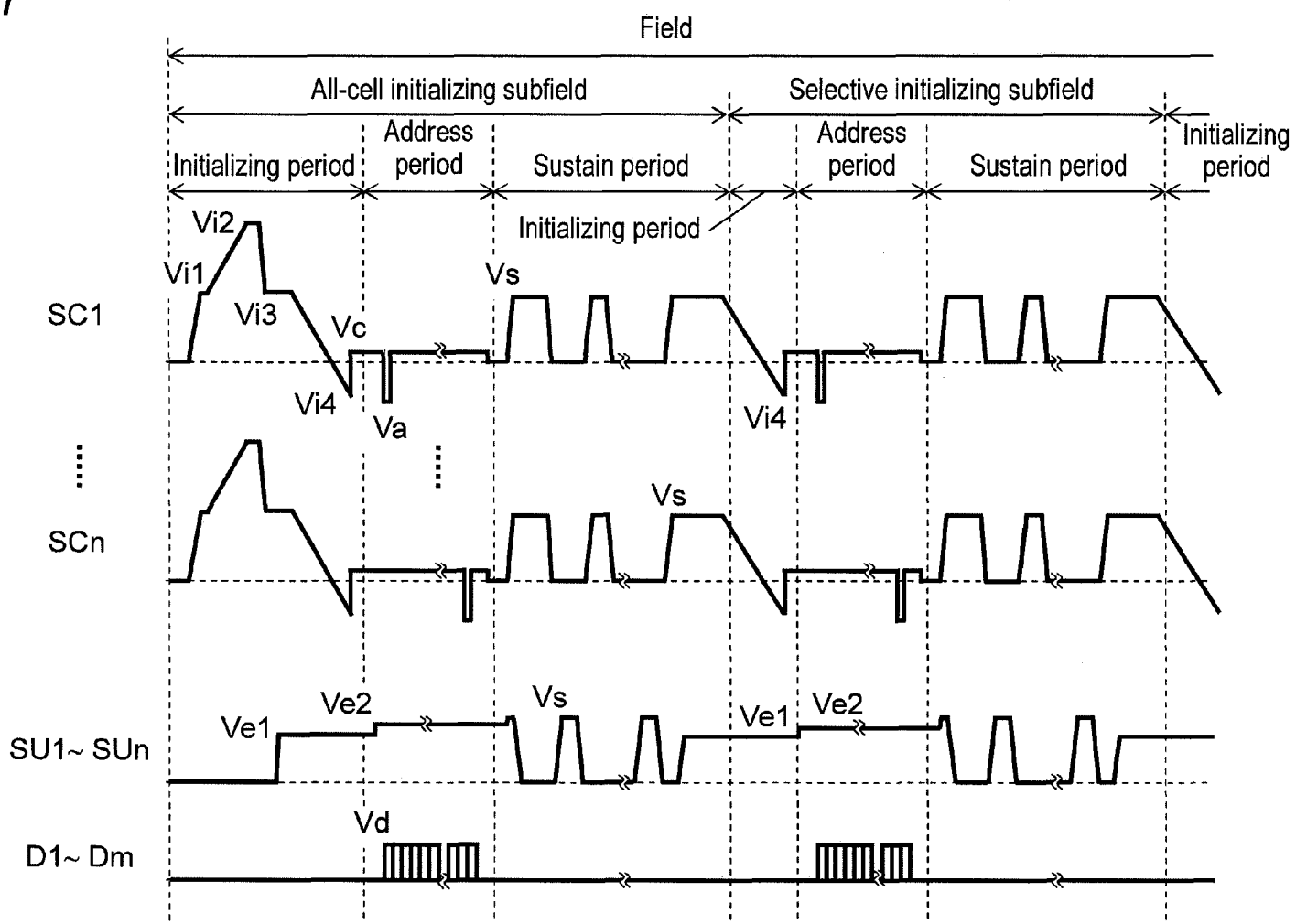
FIG. 7 is a waveform chart of driving voltages to be applied to respective electrodes of the panel.

FIG. 7 is a waveform chart of driving voltages to be applied to respective electrodes of panel 10 in accordance with the exemplary embodiment of the present invention. FIG. 7 shows a subfield in which an all-cell initializing operation is performed, and a subfield in which a selective initializing operation is performed.

First, a description is provided for a subfield in which an all-cell initializing operation is performed (an all-cell initializing subfield).

In the first half of the initializing period, 0 (V) is applied to each of data electrodes D1 through Dm and sustain electrodes SU1 through SUn, and a ramp waveform voltage is applied to scan electrodes SC1 through SCn. Here, the ramp waveform voltage gradually rises from voltage Vi1, which is equal to or lower than a discharge start voltage, toward voltage Vi2, which exceeds the discharge start voltage, with respect to sustain electrodes SU1 through SUn.

While this ramp waveform voltage is rising, a weak initializing discharge occurs between scan electrodes SC1 through SCn and sustain electrodes SU1 through SUn, and between the scan electrodes and data electrodes D1 through Dm. Then, negative wall voltage accumulates on scan electrodes SC1 through SCn. Positive wall voltage accumulates on data electrodes D1 through Dm and sustain electrodes SU1 through SUn. Here, the wall voltages on the electrodes represent the voltages that are generated by wall charge accumulated on the dielectric layers covering the electrodes, the protective layer, and the phosphor layers, for example. In this initializing discharge, wall voltages are excessively accumulated prior to the subsequent latter half of the initializing period in which the wall voltages are optimized.

Next, in the latter half of the initializing period, voltage Ve1 is applied to sustain electrodes SU1 through SUn, and a ramp waveform voltage is applied to scan electrodes SC1 through SCn. Here, the ramp waveform voltage gradually falls from voltage Vi3, which is equal to or lower than the discharge start voltage, toward voltage Vi4, which exceeds the discharge start voltage, with respect to sustain electrodes SU1 through SUn. During this application, a weak initializing discharge occurs between scan electrodes SC1 through SCn and sustain electrodes SU1 through SUn, and between the scan electrodes and data electrodes D1 through Dm. This weak discharge reduces the negative wall voltage on scan electrodes SC1 through SCn, and the positive wall voltage on sustain electrodes SU1 through SUn, and adjusts the positive wall voltage on data electrodes D1 through Dm to a value appropriate for the address operation. In this manner, the all-cell initializing operation for causing the initializing discharge in all the discharge cells is completed.

In the subsequent address period, voltage Ve2 is applied to sustain electrodes SU1 through SUn, and voltage Vc is applied to scan electrodes SC1 through SCn.

Next, negative scan pulse voltage Va is applied to scan electrode SC1 in the first line. Positive address pulse voltage Vd is applied to data electrode Dk (k is 1 through m) of a discharge cell to be lit in the first line, among data electrodes D1 through Dm. At this time, the voltage difference in the intersecting part between data electrode Dk and scan electrode SC1 is obtained by adding the difference in an externally applied voltage (voltage Vd-voltage Va) to the difference between the wall voltage on data electrode Dk and the wall voltage on scan electrode SC1. Thus the voltage difference exceeds the discharge start voltage. Then, an address discharge occurs between data electrode Dk and scan electrode SC1, and between sustain electrode SU1 and scan electrode SC1. Positive wall voltage accumulates on scan electrode SC1 and negative wall voltage accumulates on sustain electrode SU1. Negative wall voltage also accumulates on data electrode Dk.

Here, the time after application of scan pulse voltage Va and address pulse voltage Vd until generation of an address discharge is referred to as "discharge delay time". If a panel has low electron emission performance and thus a long discharge delay time, the time periods during which scan pulse voltage Va and address pulse voltage Vd are applied for a reliable address operation, i.e. a scan pulse width and an address pulse width, need to be set longer. Thus the address operation cannot be performed at high speed. If a panel has low charge retention performance, the values of scan pulse voltage Va and address pulse voltage Vd need to be set higher in order to compensate for a decrease in the wall voltages. However, because panel 10 of the exemplary embodiment has high electron emission performance, the scan pulse width and address pulse width can be set shorter than those of the conventional panel and the address operation can be performed stably at high speed. Further, because panel 10 of the exemplary embodiment has high charge retention performance, the values of scan pulse voltage Va and address pulse voltage Vd can be set lower than those of the conventional panel.

In this manner, the address operation is performed to cause the address discharge in the discharge cells to be lit in the first line and to accumulate wall voltages on the corresponding electrodes. On the other hand, the voltage in the intersecting parts between data electrodes D1 through Dm applied with no address pulse voltage Vd and scan electrode SC1 does not exceed the discharge start voltage, so that no address discharge occurs. The above address operation is repeated until the operation reaches the discharge cells in the n-th line, and the address period is completed.

In the subsequent sustain period, first, positive sustain pulse voltage Vs is applied to scan electrodes SC1 through SCn, and 0 (V) is applied to sustain electrodes SU1 through SUn. Then, in the discharge cells having undergone the address discharge, the voltage difference between scan electrode SCi and sustain electrode SUi is obtained by adding sustain pulse voltage Vs to the difference between the wall voltage on scan electrode SCi and the wall voltage on sustain electrode SUi. Thus the voltage difference exceeds the discharge start voltage.

Then, a sustain discharge occurs between scan electrode SCi and sustain electrode SUi, and ultraviolet light generated at this time causes phosphor layers 35 to emit light. Negative wall voltage accumulates on scan electrode SCi, and positive wall voltage accumulates on sustain electrode SUi. Positive wall voltage also accumulates on data electrode Dk. In the discharge cells having undergone no address discharge in the address period, no sustain discharge occurs and the wall voltage at the completion of the initializing period is maintained.

Subsequently, 0 (V) is applied to scan electrodes SC1 through SCn, and sustain pulse voltage Vs is applied to sustain electrodes SU1 through SUn. In the discharge cell having undergone the sustain discharge, the voltage difference between sustain electrode SUi and scan electrode SCi exceeds the discharge start voltage. Then, a sustain discharge occurs between sustain electrode SUi and scan electrode SCi again. Thus negative wall voltage accumulates on sustain electrode SUi, and positive wall voltage accumulates on scan electrode SCi. Similarly, sustain pulses corresponding in number to the luminance weight are applied alternately to scan electrodes SC1 through SCn and sustain electrodes SU1 through SUn to cause a potential difference between the electrodes of each display electrode pair. Thereby, the sustain discharge is continued in the discharge cells having undergone the address discharge in the address period.

At the end of the sustain period, a potential difference in the form of a so-called narrow-width pulse or a potential difference in a ramp waveform is caused between scan electrodes SC1 through SCn and sustain electrodes SU1 through SUn. Thereby, while the positive wall voltage is left on data electrode Dk, the wall voltages on scan electrode SCi and sustain electrode SUi are erased.

Next, a description is provided for the operation in a subfield in which a selective initializing operation is performed (selective initializing subfield).

In the initializing period for a selective initializing operation, voltage Ve1 is applied to sustain electrodes SU1 through SUn, 0 (V) is applied to data electrodes D1 through Dm, and a ramp voltage gradually falling toward voltage Vi4 is applied to scan electrode SC1 through SCn. In the discharge cells having undergone a sustain discharge in the sustain period of the preceding subfield, a weak initializing discharge occurs and reduces the wall voltages on scan electrode SCi and sustain electrode SUi. On data electrode Dk, sufficient positive wall voltage is accumulated by the immediately preceding sustain discharge. Thus the excess part of the wall voltage is discharged, and the wall voltage is adjusted to a value appropriate for the address operation.

On the other hand, in the discharge cells having undergone no sustain discharge in the preceding subfield, no discharge occurs, and the wall charge at the completion of the initializing period of the preceding subfield is maintained. In this manner, in the selective initializing operation, an initializing discharge is caused selectively in the discharge cells having undergone a sustain operation in the sustain period of the immediately preceding subfield.

The operation in the subsequent address period is similar to the operation in the address period of the subfield in which the all-cell initializing operation is performed, and the description is omitted. The operation in the subsequent sustain period is similar, except for the number of sustain pulses.

Next, a description is provided for a subfield structure of a driving method of the exemplary embodiment. The feature of the driving method of the exemplary embodiment is as follows. The subfields are disposed so that the luminance weight is monotonically decreased from an all-cell initializing subfield to the subfield immediately preceding the next all-cell initializing subfield. That is, the luminance weight of the selective initializing subfield succeeding an all-cell initializing subfield is set smaller than or equal to the luminance weight of the immediately preceding subfield. Another selective initializing subfield succeeding the selective initializing subfield is set smaller than or equal to the luminance weight of the immediately preceding subfield. In this manner, subfields are disposed so that the luminance weight is monotonically decreased from an all-cell initializing subfield to the subfield immediately preceding the next all-cell initializing subfield. Such a subfield structure is simply referred to as "descending coding" hereinafter.

Figure 8:
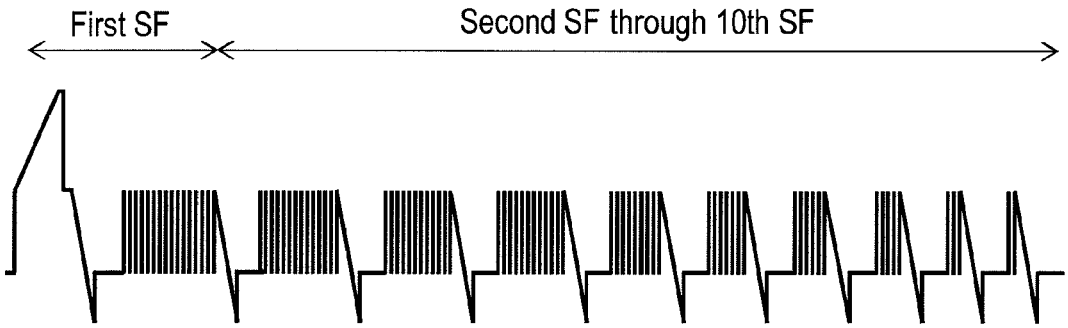
FIG. 8 is a diagram showing a subfield structure in accordance with the exemplary embodiment of the present invention.

FIG. 8 is a diagram showing a subfield (SF) structure in accordance with the exemplary embodiment of the present invention. In the exemplary embodiment, one field is divided into 10 subfields (the first SF, and the second SF to the 10th SF), and the respective subfields have luminance weights of 80, 60, 44, 30, 18, 11, 6, 3, 2, and 1 in this order. The first SF is an all-cell initializing subfield. Each of the second SF through the 10th SF is a selective initializing subfield. FIG. 8 schematically shows a driving voltage waveform to be applied to scan electrodes 22 in one field. The details of the driving voltage waveforms in each period of each subfield are as shown in FIG. 7.

As described above, in the exemplary embodiment, panel 10 is driven by descending coding. Driving by descending coding enables further high-speed stable address operation while making full use of the performance of panel 10 that can be driven at high speed. Thus a plasma display device having excellent image display quality can be implemented. In addition, driving by descending coding can further reduce the address pulse voltage and thus the power consumption of the plasma display device.

The reasons for the above advantageous effects are described hereinafter. The inventors have measured the discharge delay time of panel 10 of the exemplary embodiment. The panel subjected to measurement, which is in accordance with the present invention, has protective layer 26 made of base protective layer 26*b* and particle layer 26*b*. The particle layer is formed by discretely sticking, to the base protective layer, agglomerated particles 28 in which a plurality of single-crystal particles 27 of magnesium oxide are agglomerated. The panel is a 42-inch diagonal panel having high luminance and high definition, in which 100% xenon gas is used as a discharge gas. For comparison, a discharge delay time is measured for a conventional panel that has only base protective layer 26*a* and no particle layer 26*b*.

The discharge delay time of an address discharge is measured in a discharge cell controlled so that the discharge cell is not influenced by the discharge in the surrounding discharge cells and no address discharge is caused in the adjacent cells. The discharge delay time is influenced by phosphor materials. The measurement is performed on the discharge cell having a green phosphor prone to have a longer discharge delay time.

First, in order to obtain the relation between a discharge delay time and a lapse of time since an all-cell initializing operation, the discharge delay time is measured when an address operation is performed in only one of the first SF through the 10th SF. The number of sustain pulses at this time is two in any subfield. Further, in order to obtain the relation between a discharge delay time and the number of sustain pulses, the discharge delay time is measured when an address operation is performed only in the fifth SF and the number of sustain pulses in the sustain periods thereafter is changed from 2 to 256.

Figure 9A:
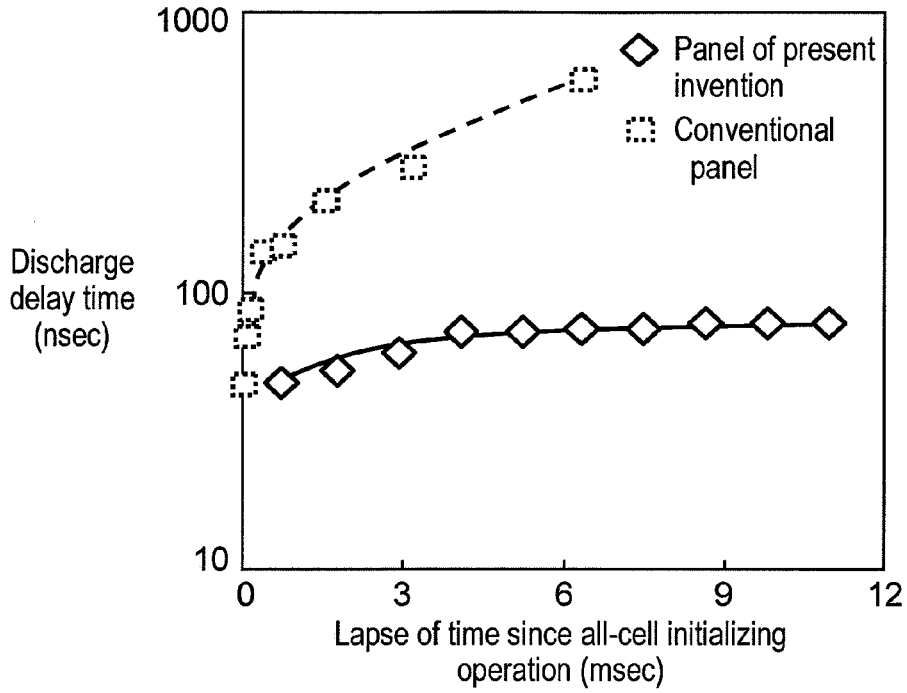
FIG. 9A is a graph showing the relation between a discharge delay time and a lapse of time since an all-cell initializing operation in the panel in accordance with the exemplary embodiment.
Figure 9B:
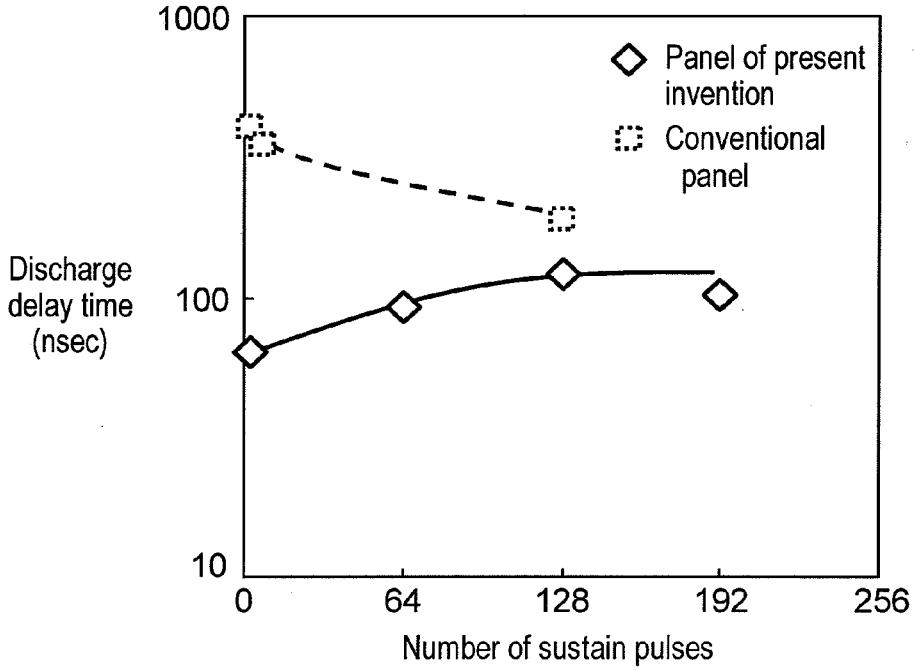
FIG. 9B is a graph showing the relation between the discharge delay time and the number of sustain pulses in the panel.

FIG. 9A is a graph showing the relation between a discharge delay time and a lapse of time since an all-cell initializing operation in panel 10 in accordance with the exemplary embodiment of the present invention. FIG. 9B is a graph showing the relation between the discharge delay time and the number of sustain pulses in panel 10 in accordance with the exemplary embodiment. In each of FIG. 9A and FIG. 9B, the characteristics of the conventional panel for comparison are shown by a broken line.

As shown in the graphs, panel 10 of the exemplary embodiment exhibits a discharge delay time extremely shorter than that of the conventional panel. Panel 10 of the exemplary embodiment has the shorter discharge delay time because the panel has high electron emission performance. According to FIG. 9A, panel 10 of the exemplary embodiment tends to exhibit a longer discharge delay time as a longer time elapses from the all-cell initializing operation. This tendency is similarly observed in the conventional panel. This is considered to be because priming generated in the all-cell initializing operation decreases with time and this decrease makes the discharge difficult to occur.

On the other hand, the relation between the discharge delay time and the number of sustain pulses is focused. As shown in FIG. 9B, the conventional panel tends to exhibit a shorter discharge delay time as the number of sustain pulses is increased. In contrast, panel 10 of the exemplary embodiment tends to exhibit a longer discharge delay time as the number of sustain pulses is increased. Typically, it is considered that, when the number of sustain pulses is increased, the priming caused by the sustain discharge is increased and thus the discharge delay time decreases. However, panel 10 of the exemplary embodiment shows an opposite tendency. The causes for such a tendency shown in panel 10 of the exemplary embodiment have not yet clarified completely. As one of the possibilities thereof, the following reason can be considered. In a formative delay time and a statistical delay time that determine a discharge delay time, the statistical delay time considerably influenced by priming is already sufficiently short. Thus the priming caused by the sustain discharge does not make great contribution to the discharge delay time. In panel 10 of the exemplary embodiment, its charge retention performance is higher than that of the conventional panel, but the wall charge slightly decreases. Thus the wall voltage decreases in response to the sustain discharge, the voltage substantially applied between the electrodes decreases, and the discharge formative delay time increases. As a result, the discharge delay time increases.

In a panel having low electron emission performance, while the influence of the priming on the statistical delay time covers a large range of 100 ns to 1,000 ns, the influence of a decrease in the wall voltage on the formative delay time covers a relatively small range of 100 ns. For this reason, for a panel having low electron emission performance, the influence of the priming on the statistical delay time is larger. Thus the discharge delay time decreases as the number of sustain pulses is increased. However, for a panel having high electron emission performance like panel 10 of the exemplary embodiment, priming has little influence on the discharge delay. Thus, even with high charge retention performance, the influence of a decrease in the wall voltage on the statistical delay time is greater. As a result, the discharge delay time increases as the number of sustain pulses is increased.

As described above, panel 10 of the exemplary embodiment tends to have a longer discharge delay time as the number of sustain pulses is increased. Further, the panel also tends to have a longer discharge delay time as a longer time elapses from the all-cell initializing operation. Therefore, subfields are disposed so that the number of sustain pulses is increased as a shorter time elapses from the all-cell initializing operation, and the number of sustain pulses is decreased as a longer time elapses from the all-cell initializing operation. This subfield structure of descending coding can cancel out the conditions of the longer discharge delay time and the conditions of the shorter discharge delay time. Thus the subfield structure enables high-speed driving by taking full advantage of panel 10 of the exemplary embodiment.

Figure 10:
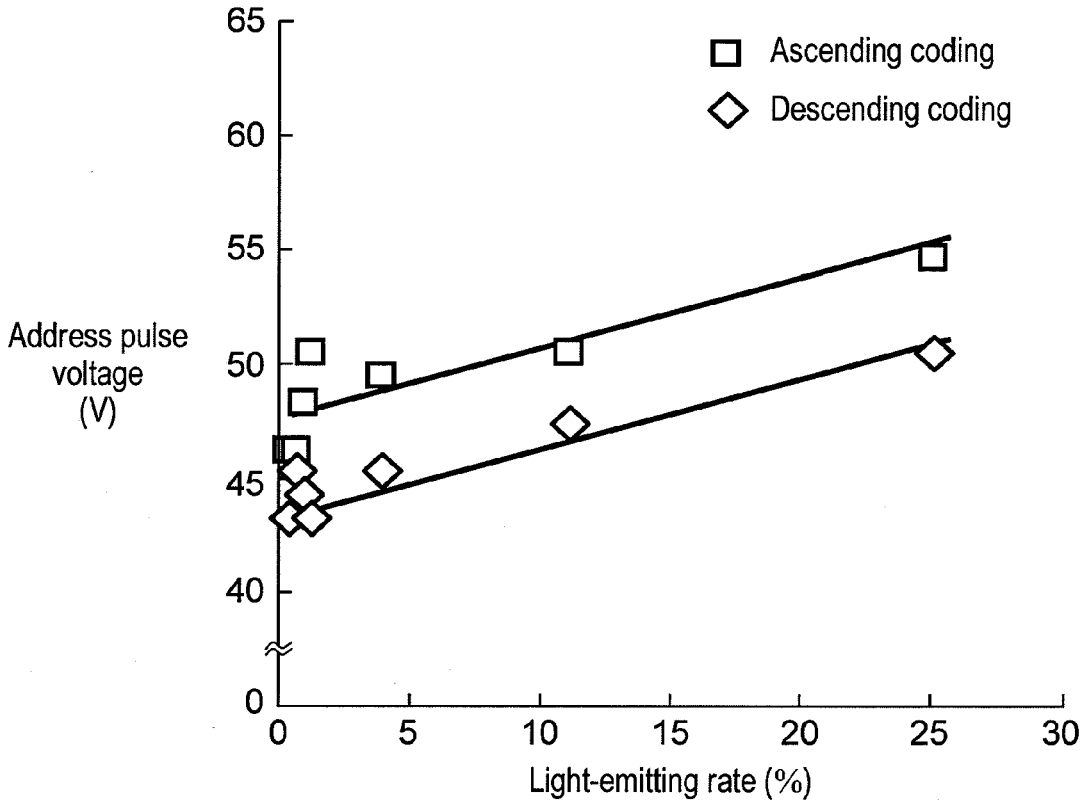
FIG. 10 is a graph showing minimum voltages to be applied to data electrodes when the panel is driven in a subfield structure of descending coding, and a subfield structure of ascending coding.

Such a subfield structure of descending coding can also reduce the voltage to be applied to data electrodes D1 through Dm. FIG. 10 is a graph showing minimum voltages to be applied to data electrodes D1 through Dm when panel 10 of the exemplary embodiment is driven in a subfield structure of descending coding, and in a subfield structure of ascending coding. In the descending coding, the subfields are disposed so that the luminance weight is monotonically decreased. In the ascending coding, the subfields are disposed so that the luminance weight is monotonically increased. As shown in the graph, the voltages necessary for the address pulse are increased in response to the increase in light-emitting rates. However, in the subfield structure of descending coding, address pulse voltage Vd can be reduced by approximately 5 (V). Thus the power consumption of the data electrode driving circuit can be reduced.

Next, a description is provided for an example of a panel driving circuit for generating the above driving voltages and driving panel 10.

Figure 11:
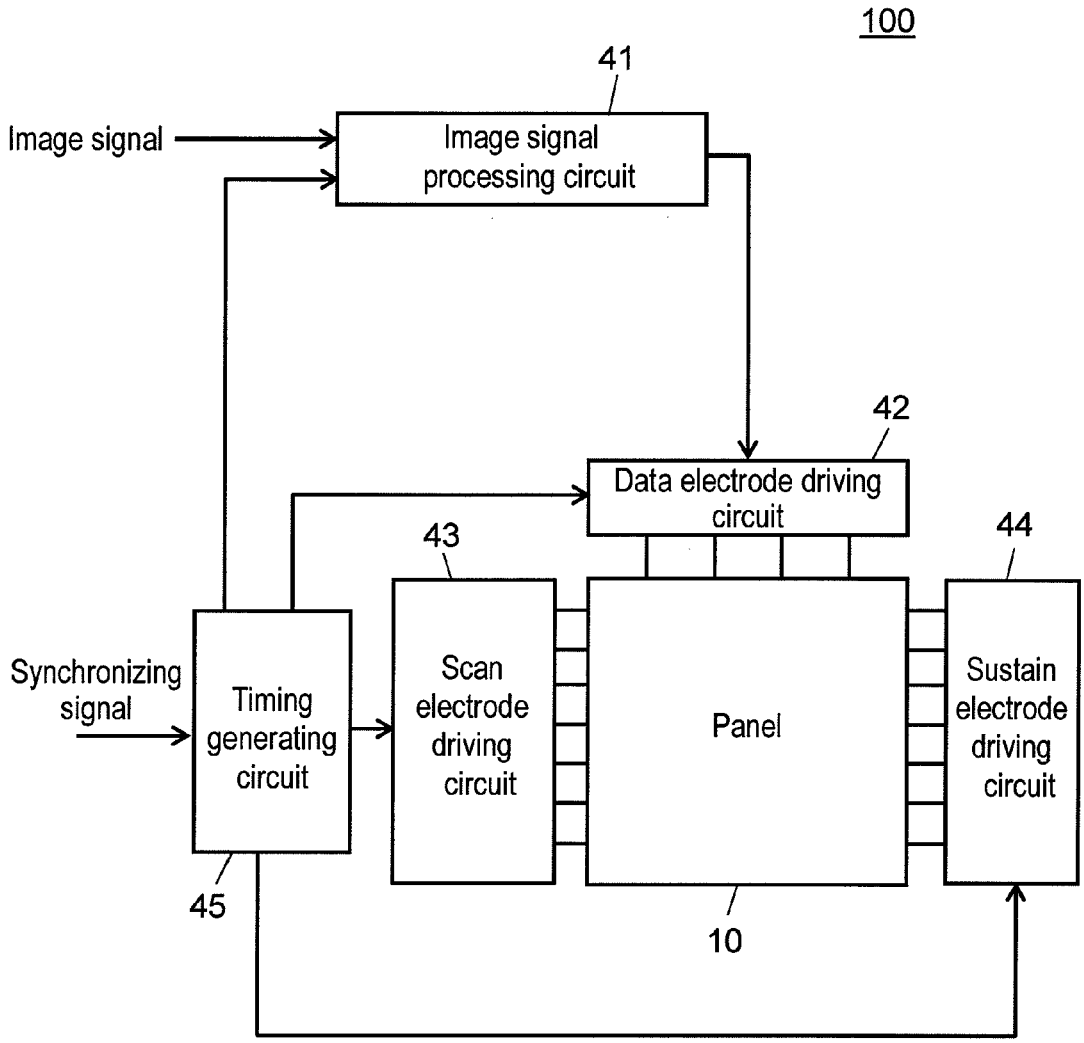
FIG. 11 is a circuit block diagram of a plasma display device in accordance with the exemplary embodiment of the present invention.

FIG. 11 is a circuit block diagram of plasma display device 100 in accordance with the exemplary embodiment of the present invention. Plasma display panel 100 has panel 10 and a panel driving circuit. Protective layer 26 of panel 10 has base protective layer 26*a* and particle layer 26*b*. The base protective layer is formed of a thin film containing magnesium oxide. The particle layer is formed by discretely sticking, to base protective layer 26*a* across the entire surface thereof, agglomerated particles 28 in which a plurality of single-crystal particles 27 of magnesium oxide are agglomerated. The panel driving circuit drives panel 10 in the following manner. In the initializing periods, an all-cell initializing operation for causing an initializing discharge in all the discharge cells, or a selective initializing operation for causing an initializing discharge in the discharge cells having undergone a sustain discharge is performed. Further, subfields are temporally disposed so that the luminance weight is monotonically decreased from the subfield in which an all-cell initializing operation is performed to the subfield immediately preceding the subfield in which the next all-cell initializing operation is performed. The panel driving circuit has the following elements:

image signal processing circuit 41;

data electrode driving circuit 42;

scan electrode driving circuit 43;

sustain electrode driving circuit 44;

timing generating circuit 45; and power supply circuits (not shown) for supplying power necessary for each circuit block.

Image signal processing circuit 41 converts input image signals into image data indicating light emission and no light emission in each subfield. Data electrode driving circuit 42 converts the image data in each subfield into a signal corresponding to each of data electrodes D1 through Dm, and drives each of data electrodes D1 through Dm. Timing generating circuit 45 generates various timing signals for controlling the operation of each circuit block according to a horizontal synchronizing signal and a vertical synchronizing signal, and supplies the timing signals to each circuit block. Scan electrode driving circuit 43 drives each of scan electrodes SC1 through SCn, according to the timing signals. Sustain electrode driving circuit 44 drives sustain electrodes SU1 through SUn, according to the timing signals.

Figure 12:
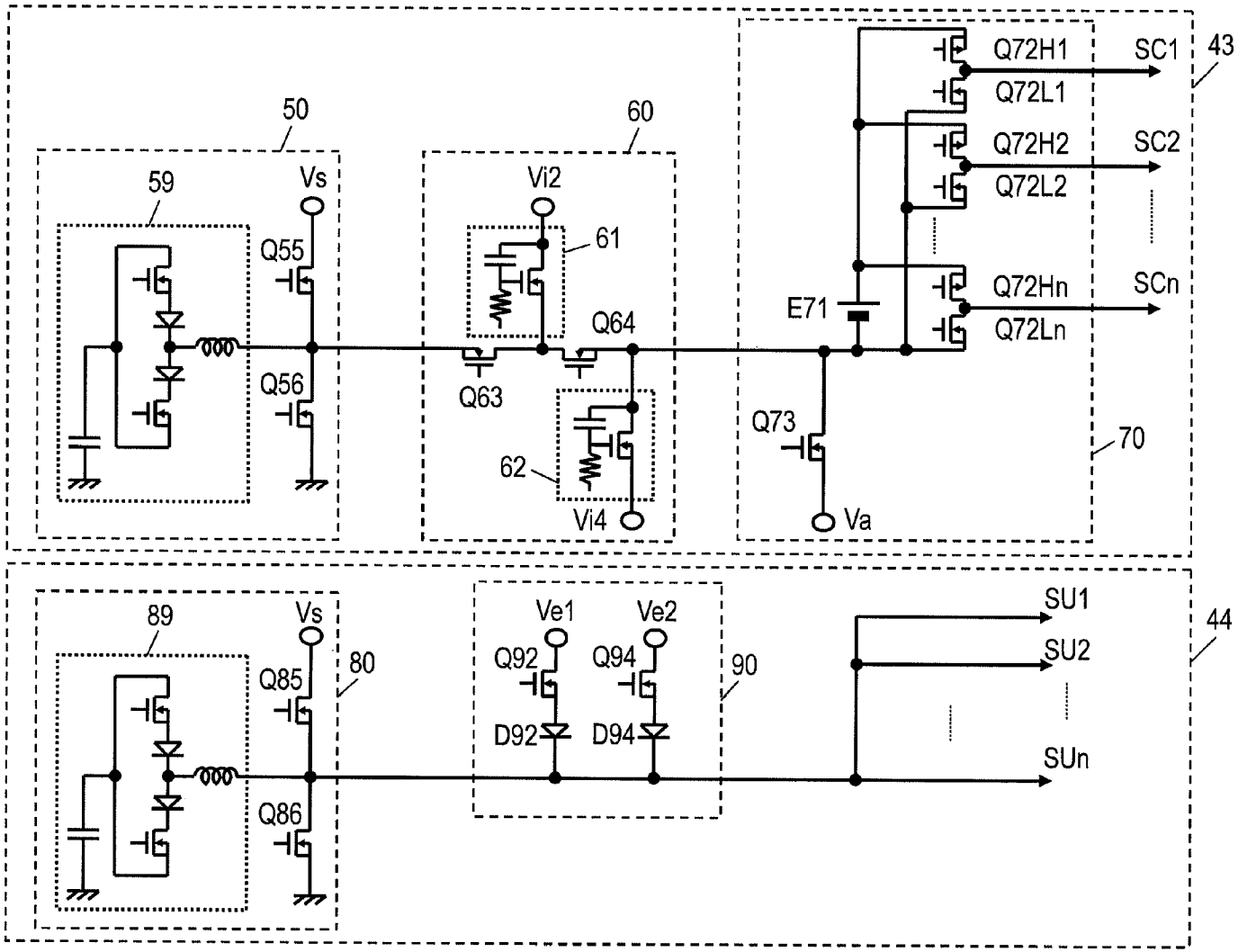
FIG. 12 is a circuit diagram of a scan electrode driving circuit and a sustain electrode driving circuit of the plasma display device.

FIG. 12 is a circuit diagram of scan electrode driving circuit 43 and sustain electrode driving circuit 44 of plasma display device 100 in accordance with the exemplary embodiment of the present invention.

Scan electrode driving circuit 43 has sustain pulse generating circuit 50, initializing waveform generating circuit 60, and scan pulse generating circuit 70. Sustain pulse generating circuit 50 has the following elements:

switching element Q55 for applying voltage Vs to scan electrodes SC1 through SCn;

switching element Q56 for applying 0 (V) to scan electrodes SC1 through SCn; and power recovering section 59 for recovering power when sustain pulses are applied to scan electrodes SC1 through SCn.

Initializing waveform generating circuit 60 has Miller integrating circuit 61 for applying an up-ramp waveform voltage to scan electrodes SC1 through SCn, and Miller integrating circuit 62 for applying a down-ramp waveform voltage to scan electrodes SC1 through SCn. Switching element Q63 and switching element Q64 are disposed to prevent backflow of current via parasitic diodes, for example, of other switching elements. Scan pulse generating circuit 70 has the following elements:

floating power supply E71;

switching elements Q72H1 through Q72Hn for applying the voltage at the high-voltage side of floating power supply E71 to scan electrodes SC1 through SCn;

switching elements Q72L1 through Q72Ln for applying the voltage at the low-voltage side of the floating power supply to the scan electrodes; and switching element Q73 for fixing the voltage at the low-voltage side of floating power supply E71 to voltage Va.

Sustain electrode driving circuit 44 has sustain pulse generating circuit 80, and initializing/address voltage generating circuit 90. Sustain pulse generating circuit 80 has the following elements:

switching element Q85 for applying voltage Vs to sustain electrodes SU1 through SUn;

switching element Q86 for applying 0 (V) to sustain electrodes SU1 through SUn; and power recovering section 89 for recovering power when sustain pulses are applied to sustain electrodes SU1 through SUn.

Initializing/address voltage generating circuit 90 has the following elements:

switching element Q92 and diode D92 for applying voltage Ve1 to sustain electrodes SU1 through SUn, and switching element Q94 and diode D94 for applying voltage Ve2 to sustain electrodes SU1 through SUn.

These switching elements can be configured of generally known devices, such as a metal oxide semiconductor field-effect transistor (MOSFET), and an insulated gate bipolar transistor (IGBT). These switching elements are controlled, according to timing signals that are generated in timing generating circuit 45 and correspond to the switching elements.

The driving circuit of FIG. 12 is an example of a circuit configuration for generating the driving voltage waveforms of FIG. 7. The plasma display device of the present invention is not limited to this circuit configuration.

Figure 13:
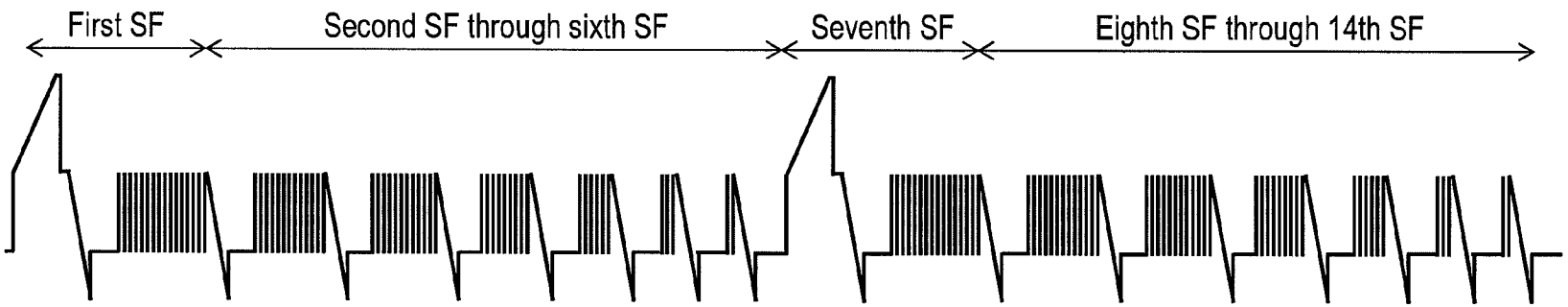
FIG. 13 is a diagram showing a subfield structure in accordance with another exemplary embodiment of the present invention.

In the description of the exemplary embodiment, one field is divided into 10 subfields, and only the first SF is an all-cell initializing subfield. However, the present invention is not limited to this structure. FIG. 13 is a diagram showing a subfield structure in accordance with another exemplary embodiment of the present invention. In FIG. 13, the number of subfields is 14, and the first SF and the seventh SF are all-cell initializing subfields. Further, the subfields are disposed so what the luminance weight is monotonically decreased from the first SF to the sixth SF, and also from the seventh SF to the 14th SF. It is important that the luminance weight is monotonically decreased from an all-cell initializing subfield to the subfield preceding the next all-cell initializing subfield in this manner. The number of subfields may be set optionally as required. The subfield in which an all-cell initializing operation is performed, and the number of the all-cell initializing subfields can be set optionally.

The respective specific values for use in the exemplary embodiment are merely examples. It is preferable to set values optimum for the characteristics of the panel, the specifications of the plasma display device, or the like, for each case.

Industrial Applicability

The plasma display device of the present invention is capable of performing high-speed stable address operation, and displaying images of excellent display quality, and thus is useful as a display device.

The invention claimed is:

1. A plasma display device comprising:

a plasma display panel including:

a front plate including a first glass substrate on which display electrode pairs are formed, a dielectric layer covering the display electrode pairs, and a protective layer formed on the dielectric layer;

a back plate disposed facing the front plate, the back plate including a second glass substrate on which data electrodes are formed such that the data electrodes of the back plate are facing the display electrode pairs of the front plate; and discharge cells formed between positions where the display electrode pairs are facing the data electrodes; and a panel driving circuit for driving the plasma display panel such that a plurality of subfields are temporally disposed to form one field period, each subfield of the plurality of subfields having an initializing period for causing an initializing discharge, an address period for causing an address discharge, and a sustain period for causing a sustain discharge in the discharge cells, wherein the protective layer includes:

a base protective layer formed of a thin film containing a metal oxide; and a particle layer formed by discretely sticking, to the base protective layer, agglomerated particles in which a plurality of single-crystal particles of magnesium oxide are aggregated by static electricity between the plurality of single-crystal particles of magnesium oxide and are distributed across the entire surface of the base protective layer, wherein the panel driving circuit is configured to drive the plasma display panel such that, in the initializing period of a subfield of the plurality of subfields, one of (i) an all-cell initializing operation causing the initializing discharge in all of the discharge cells and (ii) a selective initializing operation causing the initializing discharge in discharge cells having undergone the sustain discharge is performed, and wherein the plurality of subfields are temporally disposed such that a luminance weight is monotonically decreased from (i) a subfield in which the all-cell initializing operation is performed to (ii) a subfield in which a next all-cell initializing operation is performed.

2. The plasma display device of claim 1, wherein an average particle diameter of the plurality of single-crystal particles ranges from 0.9 μm to 2.0 μm, inclusive.

3. The plasma display device of claim 1, wherein the base protective layer is formed of a thin film of magnesium oxide.

* * * * *